United States Patent [19]

Van Brunt et al.

[11] Patent Number: 4,579,415

[45] Date of Patent: Apr. 1, 1986

[54] GROUNDING OF SHIELDED CABLES IN A PLUG AND RECEPTACLE ELECTRICAL CONNECTOR

[76] Inventors: Michael K. Van Brunt, 609 Lantana #10; Jeffrey J. Hager, 555 Rosewood #205, both of Camarillo, Calif. 93010

[21] Appl. No.: 602,668

[22] Filed: Apr. 23, 1984

[51] Int. Cl.[4] ..... H01R 13/658; H01R 17/18

[52] U.S. Cl. ..... 339/143 R; 339/177 R

[58] Field of Search ..... 339/143 R, 177 R, 177 E, 339/14 R, 89 C, 90 C; 174/35 C, 78

[56] References Cited

U.S. PATENT DOCUMENTS

| | | | |
|---|---|---|---|
| 3,280,246 | 10/1966 | Lawson et al. | 174/78 X |
| 3,465,092 | 9/1969 | Schwartz | 174/78 |
| 3,990,765 | 11/1976 | Hill | 339/143 R X |
| 4,026,628 | 5/1977 | Duffner et al. | 339/177 E |
| 4,111,513 | 9/1978 | Thurston et al. | 339/143 R |
| 4,243,290 | 1/1981 | Williams | 339/177 R X |
| 4,382,653 | 5/1983 | Blanchard | 339/143 R |

*Primary Examiner*—Gil Weidenfeld
*Assistant Examiner*—Steven C. Bishop

[57] ABSTRACT

Cable wires to be interconnected by a plug and receptacle connector are received within the end portion of each connector part, the cables themselves being conventionally connected to a pin and socket contacts. The contacts are received within insulative inserts which, in turn, are mounted within metal shell members. A portion of the cable shields outwardly of the insulative inserts are located on the outer end portion of a connector part metal shell surrounding the inserts. A metal ring is placed over the individual cable shields and formed in place mechanically securing and electrically connecting the cable shields to the metal cylinder and thus to the connector part.

3 Claims, 4 Drawing Figures

GROUNDING OF SHIELDED CABLES IN A PLUG AND RECEPTACLE ELECTRICAL CONNECTOR

The present invention relates generally to the grounding of shielded cables in a plug and receptacle electrical connector, and, more particularly, to such a cable termination means at the connector to prevent pollution from external radio frequency and electromagnetic energy.

BACKGROUND OF THE DISCLOSURE

Electrical connectors having plug and receptacle parts which can be mated together for interconnecting cable wires by pins and sockets are well-known and have been found to be a highly reliable form of establishing releasable electrical connections under a great variety of environments. The cable wires are typically enclosed by a shield such as a metal braid for grounding at the cable ends to prevent radio frequency and electromagnetic energy in the surroundings from interfering with the equipment to which the cables connect. Also, such shields are useful in preventing cross-interference with other cables.

There has been considerable concern expressed about the possibility of nuclear explosions generating an electrical pulse (EMP) of such magnitude as to destroy communications and wipe out data bases in computers, for example, over a relatively large geographical area. Such a problem not only has severe consequences for the public generally, but also would be devastating on military electronics. Shielding of sensitive electronic circuits, components, and cables by enclosing them within a conductive member that would conduct such EMP energy to the ground can be effective, if properly handled. However, any gap that may exist in the conductive path to ground could result in destruction of the protective circuitry and, therefore, to be fully effective such grounding protection must exist not only on the cables themselves but also at any connector.

SUMMARY

The cable wires to be interconnected by a plug and receptacle connector are received within the end portion of each connector part, the cables themselves being connected to pin or socket contacts, as the case may be, in a conventional manner. The pin and socket contacts are received within insulative inserts which, in turn, are mounted within metal shell members. The termination means described herein contemplates removing a portion of the cable shields outwardly of the insulative inserts and locating the shield portions on the outer end portion of a connector part metal cylinder which surrounds the inserts. A metal ring is then placed over the individual cable shields that are located on the metal cylinder end portions and it is formed in place securing and electrically connecting the cable shields to the metal cylinder and thus the connector part.

The entire set of cable wires forming the cable itself typically has a single flexible shield enclosing each of the individual cable wires and for termination by the means described herein it is peeled back even farther than the individual cable shields terminated as already described. A metal ring of such dimensions as to permit receipt between the overall shield and the individual cables is received within the overall shield and the connector backshell is received onto the connector part over the individual termination ring and over the overall shield termination. The backshell is then secured in place making full contact with the individual shields as well as the overall cable shield and the connector parts. Application of a relatively large magnetic field pulse causes the backshell to form about the enclosed part.

DESCRIPTION OF A PREFERRED EMBODIMENT

Figure 1:
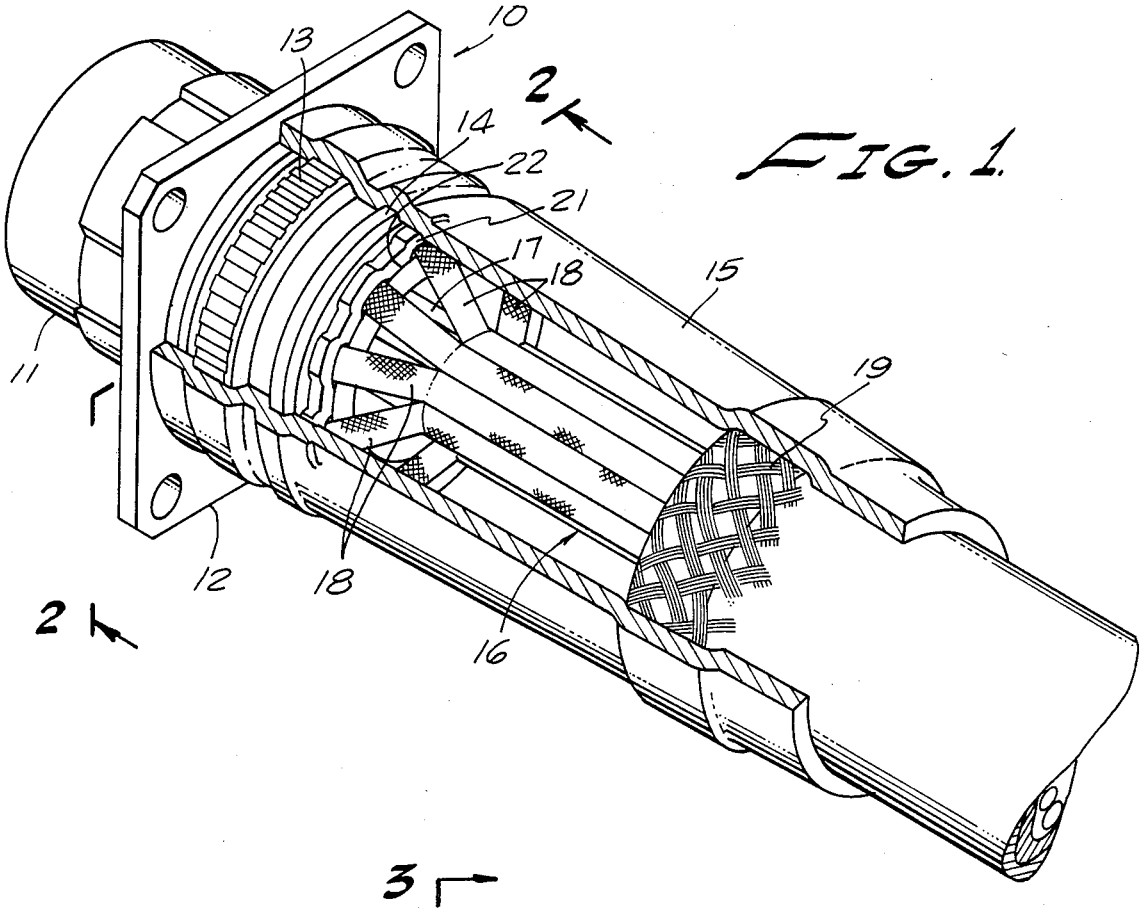
FIG. 1 is a perspective, partially sectional view of a connector part showing the described cable shield termination.

Turning now to the drawing and especially FIG. 1, one half of a plug and receptacle connector, namely a receptacle, with which the present invention can be advantageously employed is identified generally as at 10. The connector part is seen to include as a major part, a hollow generally cylindrical metal shell 11 within which pin or socket contacts may be located to establish connection in a known manner upon mating of the connector parts. That is, another connector part (plug) releasably fits with the receptacle 10 to connect paired sets of cable wires. The shell 11 and an integrally related mounting plate 12 are typically constructed of a high-quality aluminum plated with a suitable metal or alloy to prevent oxidation or corrosion.

Figure 3:
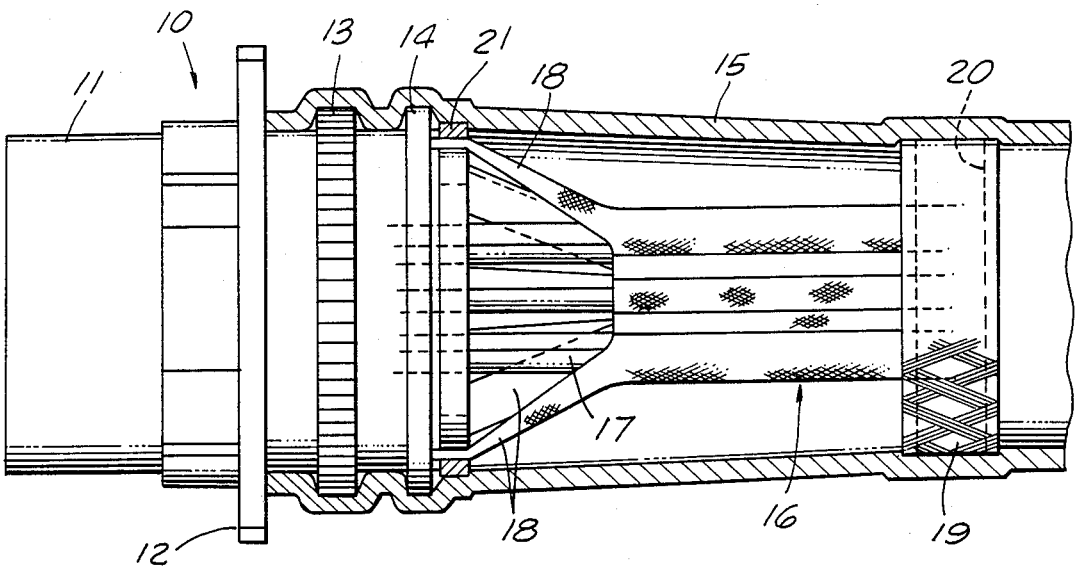
FIG. 3 is a side elevational, sectional view taken along the line 3—3 of FIG. 2.
Figure 4:
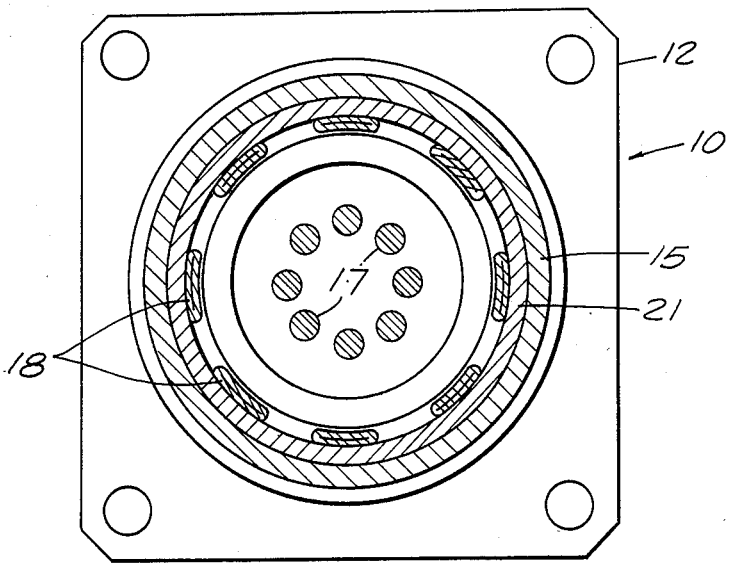
FIG. 4 is an end elevational, sectional view similar to FIG. 2 taken before deformation.

Referring now also to FIG. 3, the cylindrical shell 11 has, on the side of the mounting plate 12 at which the cable wires are to be inserted into the connector, one or more flanges 13 and 14 extending outwardly of the shell and circumferentially about the shell and which, in a way that will be described, serve as an anchoring and connection means to the cylindrical metal backshell 15.

The cable identified generally as at 16 includes a plurality of cable wires 17 each one of which includes its own shield 18. Typically, the cable wire shields are braided wire which not only is conductive so as to serve as an electromagnetic energy shield, but also is sufficiently flexible to permit desired bending of cable 16. Moreover, over the entire set of cable wires 17 with their individual shields, there is a further conductive shield 19.

Preliminary to terminating the various cable shields, the overall cable shield 19 is peeled back onto the cable itself a substantial distance from the end of the cable wires (FIGS. 1 and 3). Also, at this time an annular metal termination ring 20 is slid onto the end of the cable and located over the shield 19 and underneath the peeled back portion thereof.

Next, the outer end portion of each of the individual cable wire shields 18 are stripped off a given length from the ends of the cable wires and formed to extend angularly outwardly from the cables as individual conductors (FIG. 3). Each of these stripped-off cable shields 18 are received over and onto an outer end portion of the connector part shell 11. An appropriately dimensioned metal ring 21 is received over the ends of the stripped-off cable shields 18 and onto the end portion of the shell 11. The ring 21 is then deformed radially inwardly onto the shell 11 thereby physically and electrically securing the cable shields to the shell 11.

Figure 2:
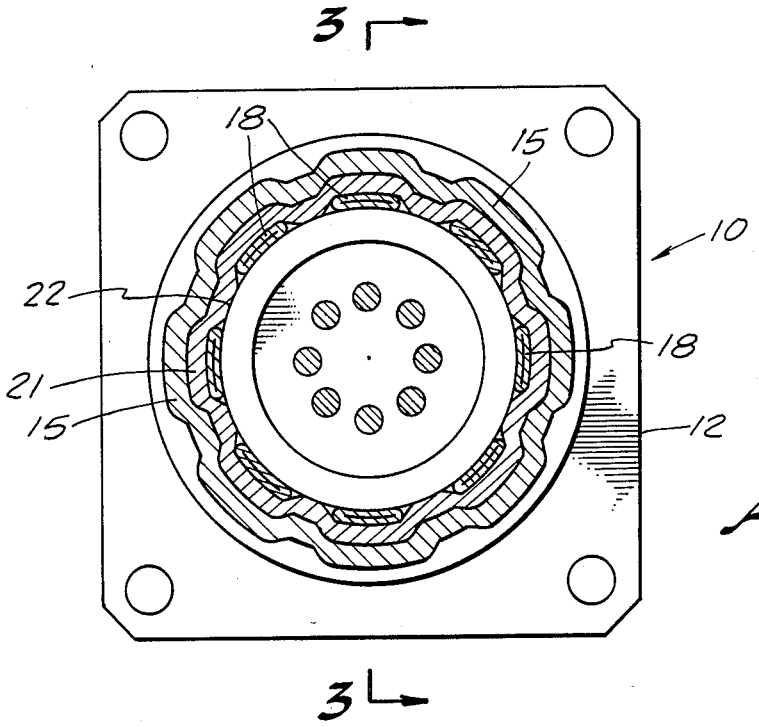
FIG. 2 is an end elevational, sectional view taken along the line 2—2 of FIG. 1.

Preferably, the ring 21 is formed about the cable shields through the application of a relatively large magnetic field which not only presses the ring material tightly against the shields, but also deforms the ring downwardly between adjacent cable shields into contact with the receptacle shell as at 22 (FIGS. 1 and 2).

An elongated metal cylinder or backshell 15 is then received onto the cable and located over flanges 13 and 14 as well as adjacent parts of the cable and termination means already described (FIG. 1). Finally, further deformation such as by a magnetic field secures the backshell 15 to the flanges 13 and 14 as well as establishing mechanical and electrical contact with the overall cable shield 19.

The cable wires forming the cable has a single flexible shield enclosing all of the wires which is peeled back farther than the individual cable shields terminated as already described. A further metal ring is received within the overall shield and the connector backshell is received onto the connector part over the individual termination ring and over the overall shield termination. The backshell is then secured in place making full contact with the individual shields as well as the overall cable shield and the connector parts.

In use of the described shielding means both the overall shield 19 for a multi-wire cable and the individual cable wire shields 18 are mechanically and electrically connected to the connector part shell (e.g., receptacle). Interference signals induced in the outermost shield 19 are interconnected to the connector part 10 via the backshell 15 and then grounded through the mounting plate 12. Any interference signals that may have been picked up by the individual shields 18 are directly fed to the connector part shell 11 closely adjacent the point where the shields leave the cable wires and then to ground. The backshell completely encloses the cable wire end of the connector part thereby preventing interference signals being induced in the cable wire and portions from which the shield 18 has been stripped.

We claim:

1. In an electrical connector part having a hollow metal shell through which a multi-wire cable passes, each wire being enclosed in a shield and a further shield enclosing all of the cable wires, the improvement comprising:

individual peeled-back portions of each cable wire shield being located in contact with the outer surface of the connector part metal shell and in mutually spaced apart relation;

metal ring means received over the peeled-back cable wire shield portions and deformed to clamp said cable wire shield portions against the connector part metal shell outer surface and against the shell outer surface between adjacent wire shield portions;

the further shield being peeled-back from the connector part metal shell onto the multi-wire cable; and hollow metal backshell means with an imperforate sidewall having one end portion deformed to clamp about the connector metal shell and onto the deformed ring means, an opposite end portion of the backshell means deformed to clamp the peeled-back portion of the further shield continuously about the multi-wire cable.

2. An electrical connector as in claim 1, in which said connector part metal shell outer surfaces includes at least one circumferentially extending flange having a toothed outer surface to which the backshell means is deformed into continuous contact free from gaps.

3. An electrical connector as in claim 1, in which a metal ring is located on the cable over the further cable shield, the peeled-back portion of the further cable shield is located over the metal ring, and the backshell means is formed onto the peeled-back portion of the further cable shield and underlying metal ring.

* * * * *